US006112653A

United States Patent [19]

Meyers

[11] Patent Number: 6,112,653

[45] **Date of Patent: *Sep. 5, 2000**

[54] PAPER ROLL IMPRESSION IDENTIFICATION

[75] Inventor: Kevin L. Meyers, Manheim, Pa.

[73] Assignee: NCR Corporation, Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/301,792

[22] Filed: Apr. 29, 1999

[51] Int. Cl.[7] ..... B31F 1/07

[52] U.S. Cl. ..... 101/32; 101/4; 101/41

[58] Field of Search ..... 101/4, 28, 32, 101/41; 400/128; 428/906; 242/159, 160.1; 100/156, 178, 264

[56] References Cited

U.S. PATENT DOCUMENTS

| | | | |
|---|---|---|---|
| 3,306,186 | 2/1967 | Voos et al. | 101/18 |
| 4,214,520 | 7/1980 | Eissel | 101/4 |
| 5,483,893 | 1/1996 | Isaac et al. . | |
| 5,518,328 | 5/1996 | Okuchi et al. | 400/249 |

*Primary Examiner*—Kimberly Asher
*Attorney, Agent, or Firm*—Millen White Zelano & Branigan PC

[57] ABSTRACT

Print rolls having subtle identifying markings impressed in the side thereof at a depth sufficient for detection at 45° angle or less. The print rolls can be prepared in a print roll press fitted with a platen containing the desired image raised above the surface of said platen. The printing press can be one used in the manufacture of the print roll.

14 Claims, 3 Drawing Sheets

PAPER ROLL IMPRESSION IDENTIFICATION

The present invention relates to rolls of print media used in printers, cash registers, calculators and the like. More particularly, the present invention relates to rolls of print media with subtle indicia positioned on at least one side of the roll for purposes of identification.

BACKGROUND OF THE INVENTION

It is often desirable to identify a roll of a print medium after it has been removed from the package and installed within a printer, cash register, etc. One example is where a printer needs to be serviced. A field technician can recognize if an improper replacement roll is the source of an equipment problem where the roll can be identified. Conventional means for identifying print rolls include color coding the cores/spindles or putting identifying marks on the cores/spindles. Other methods for identifying rolls of print media include printing markings on the side of the roll by ink jet printing.

While providing effective means for identification, these techniques have disadvantages. For example, these techniques add to the cost of the rolls of print media through the special materials used and the additional procedures necessary in handling and preparation of these marked print rolls. Printing markings on the side of the roll not only requires additional handling, it can render the roll useless if not performed properly such as if the ink is caused to leak onto the print surface of the paper.

Another disadvantage of the conventional means for identifying rolls of print media is that the markings used are typically obtrusive. When a roll of a print medium has obtrusive markings, there is a reluctance on the part of the end user to employ the roll as a replacement where it does not conform to a print roll within a printer, cash register, etc. Therefore, it is desirable that the markings be subtle.

SUMMARY OF THE INVENTION

It is an object of the present invention to provide rolls of print media with subtle markings for purposes of identification.

There is another object of the present invention to provide rolls of print media with identification marks recognized by field technicians which do not significantly alter the appearance of the rolls.

It is an additional object of the present invention to provide rolls of print media with subtle markings for purposes of identification which do not add significantly to the cost of the materials for the roll or to the cost of manufacturing the roll.

It is a further object of the present invention to provide a method for marking rolls of print media which can be incorporated in existing manufacturing methods.

The above objects are achieved through the rolls of print media and methods of the present invention.

Further objects will be apparent from the detailed disclosure below and Figures which follow.

DETAILED DESCRIPTION

The rolls of print media of this invention comprise a core/spindle and a sheet, preferably continuous, of a print medium of substantially the same width as the core/spindle. The sheet of print medium is wound around the core/spindle to provide a thickness of layered paper on the core/spindle of at least one half inch, measured from the periphery of the core/spindle to the outer layer of the sheet of print medium on the roll. At least one side of the wound sheet of print medium is marked with at least one impression which serves as an identifying mark. The "sides" of the roll of a print medium, as referred to herein, are where the edges of the wound print medium are exposed. The term "impression" as used herein includes shallow indentations as well as realignment of the edges of the wound print medium and realignment of the fibers within the wound print medium. In realigning the edges and/or fibers of the wound print medium, there may be no indentation which is detectable and in certain embodiments, no indentation at all.

The impression distorts the edge of the wound print medium sufficiently deep to be detected when viewed at an angle of 45° or less from the surface of an imaginary plane formed by the side of the roll of the print medium with the impression. The impression is also sufficiently shallow so as not to form a deep indentation that inhibits the unwinding of the sheet of the print medium off of the core/spindle.

The method of the present invention comprises feeding at least one print roll lying on a side thereof through a roll press which is adapted to align the core/spindle with the continuous sheet of print media wound thereon. The one or more rolls are then pressed under the platen of the roll press. The platen has a press plate with raised markings of height sufficient to form an impression in the side of a roll of the print medium.

Any roll of print medium which is subjected to a roll press in its manufacture can be employed in the methods of this invention. Preferably, the impressions are formed when the roll is pressed to align the wound print medium with the spindle.

Figure 1:
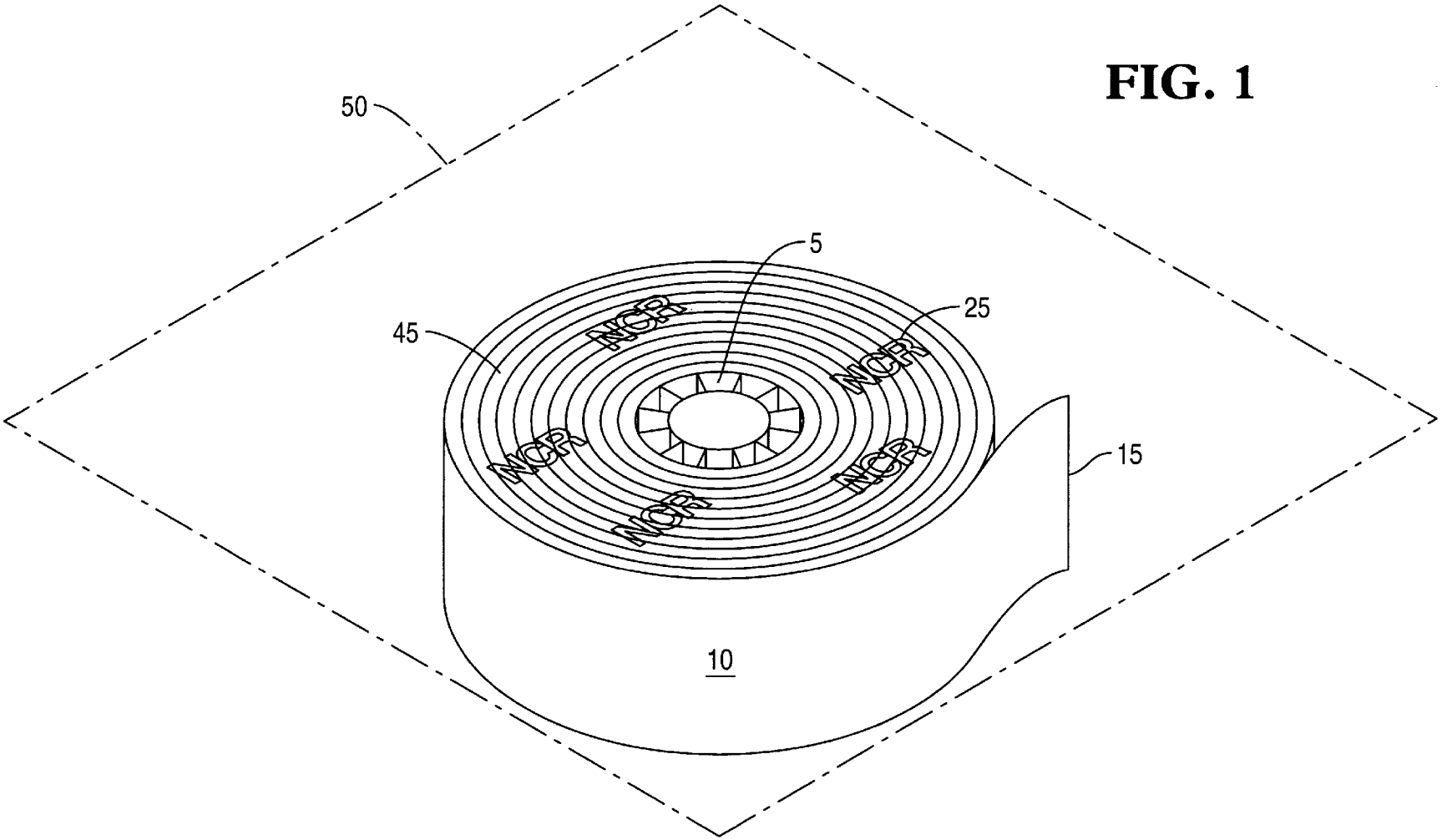
FIG. 1 is a roll of a print medium of the present invention.

FIG. 1 illustrates a roll 10 of a print medium of this invention. Core/spindle 5 can be conventional in configuration and composition. Suitable materials include plastic, paper, cardboard, wood, and metal. The term "core/spindle" as used herein is intended to include those elements referred to as "cores" as well as those referred to as "spindles" in the art. Print medium 15 is shown wound around core/spindle 5. Print medium 15 can comprise any conventional print medium and is preferably in the form of a continuous sheet. The width of print medium 15 is greater than or equal to the width of core/spindle 5 and is preferably no more than 5% wider than the core/spindle 5. Most preferably, print medium 15 is equal in width to core/spindle 5. The wound sheet of print medium 15 provides a thickness of layered paper on the spindle of at least ½" measured from the periphery of the core/spindle to the outer layer of the wound sheet of the print medium. Such a thickness is necessary to provide a surface for the subtle markings to be applied to roll 10. Preferably, the wound sheet of print medium 15 provides a thickness of layered paper on the core/spindle of at least 1", most preferably at least 2". Except for the minimum thickness of ½", the rolls of print media of the present invention are independent of size. Sizes consistent with conventional print rolls are suitable for this invention.

The print medium 15 employed in roll 10 of the present invention can be conventional in composition. Plain paper, thermal paper, bond paper ink jet paper and the like are suitable for this invention, whether coated or uncoated.

One side of roll 10 is impressed with at least one identifying mark 25. Rolls of print media with impressions on both sides of the roll are included within the scope of this invention; however, to simplify processing, marking only one side is preferred. Identifying mark 25 is an impression in the side of the roll which can be detected when viewed at an angle of 45° or less from the surface of the imaginary plane 50 formed by the side of roll 10 with identifying mark 25. In certain embodiments, identifying mark 25 can go unnoticed at an angle of 90° from the surface of this imaginary plane. The impression can be analogous to a watermark on conventional bond paper with no discernable or quantifiable indentation. Any indentation of the impression must be sufficiently shallow so as not to interfere with the dispensing (unwinding) of the print medium 15 from roll 10. This can occur if the edge of an underlying layer of print medium 15 in roll 10 overlaps the edge of an overlying layer of print medium 15 to the extent that print medium 15 tears when unwound (dispensed) from print roll 10. Forming an indentation at a depth in the range of 0.0" to about 0.010", is preferred. It is anticipated that one skilled in the art can use much deeper impressions depending on the strength of the print medium and the tightness at which the print medium 15 is wound on core/spindle 5. One skilled in the art could readily determine whether the depth of the impression is appropriate by testing the roll in the desired printer, calculator or cash register, and inspecting the roll to see if the markings can be identified at an angle of 45° or less.

Identifying mark 25 can comprise a trademark, a number and/or letter of multiple characters and/or a symbol. Identifying mark 25 is of a size preferably ¼" or more so that it may be easily observed by a field technician.

The rolls of print media of the present invention can be prepared by impressing a desired identifying mark on conventional rolls of print media. These impressions can be made with a roll press conventionally used to align cores/spindles with the print medium, which is modified. Suitable roll presses are available from Gerhart Machinery of Warminster, Pa. The press is modified by incorporation of a press plate with a raised image in the shape of the desired mark positioned on a platen of the roll press. In a preferred embodiment of the method of this invention, the rolls of print media are marked during their manufacture in the roll press operation where the paper is aligned with the core/spindle. Print rolls are typically pressed a number of times in such a roll press, which will provide a number of markings. The number of markings can be adjusted by controlling the feed rate of the rolls of print media into the press, the frequency at which the platen compresses these rolls and the number of raised markings on the platen. The locations of the identifying mark 25 can be controlled by positioning the roll of print media under the platen or the locations of the identifying mark can be completely random allowing the roll of print media to rotate or slide at random between actuations of the press. To provide impressions on both sides, the rolls of print media need only be fed through the press twice.

Figure 2:
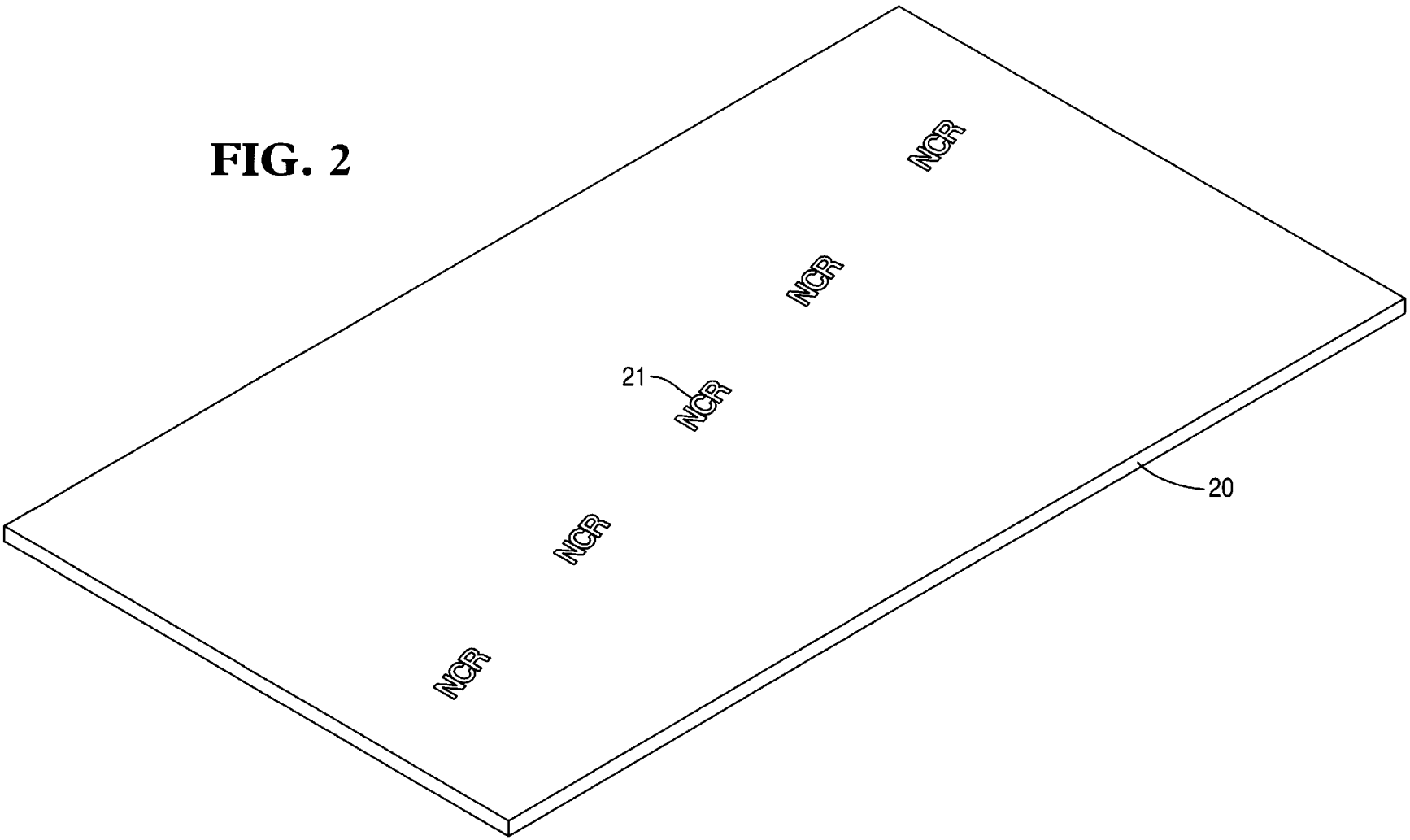
FIG. 2 is a plate used to mark rolls of print media in preparing the rolls of the present invention.

FIG. 2 is an example of a press plate 20 with multiple raised images 21 that is incorporated in a roll press.

Figure 3:
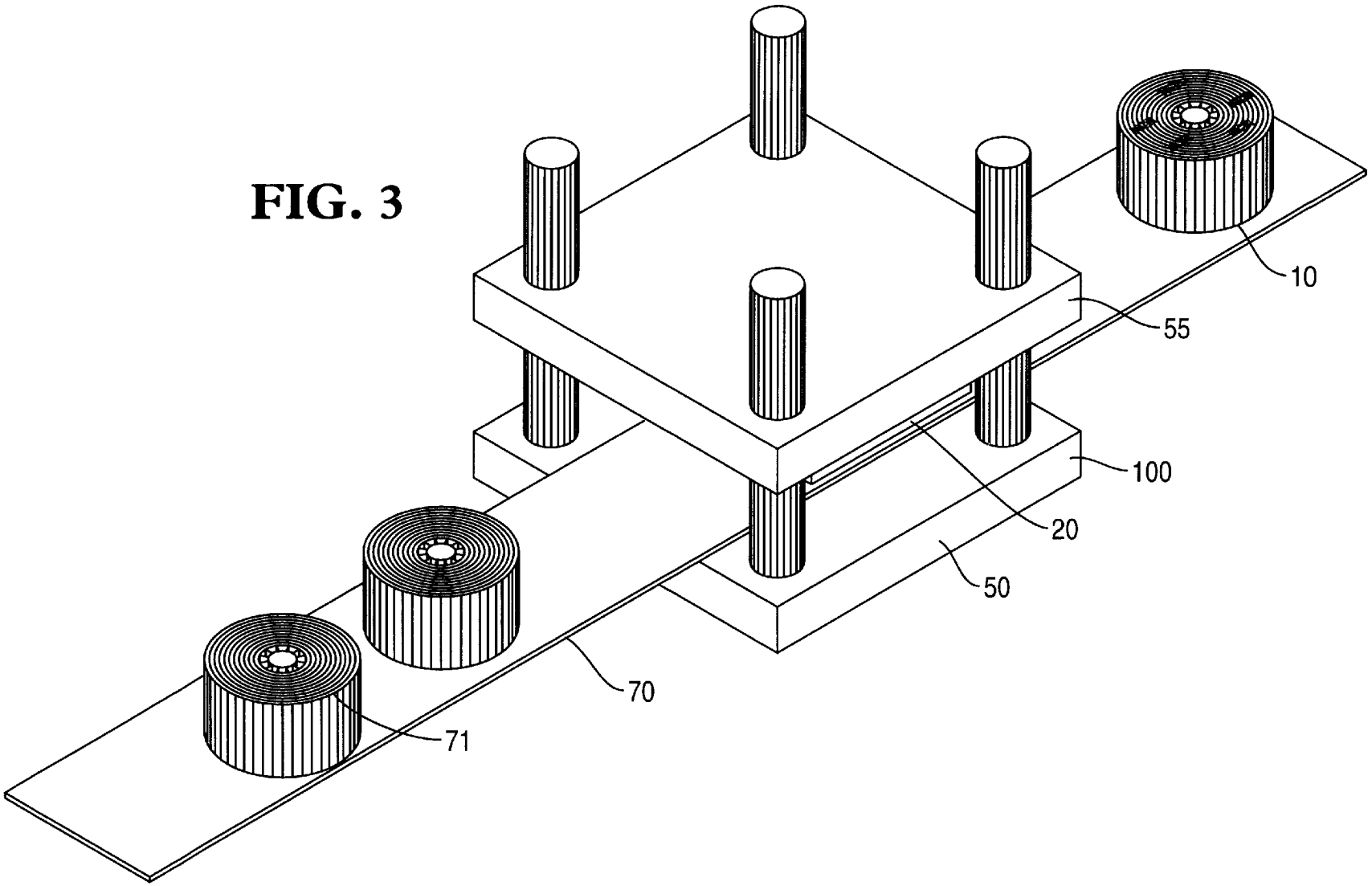
FIG. 3 is an illustration of a press operation which provides the markings for the rolls of print media of the present invention.

FIG. 3 shows the operation of a roll press 50 with press plate 20 positioned on upper platen 55. Conveyer belt 70 delivers rolls 71 to press 50. The upper platen 55 with press plate 20 is pressed toward lower platen 100 by a conventional drive means (not shown). The actuation of upper platen 55 against lower platen 100 stops the movement of conveyor belt 70. Preferably, conveyer belt 70 is clutch driven to allow slippage of the drive means when the rolls are pressed. The finished product (roll 10), shown exiting roll press 50, has been pressed 3 times.

From the foregoing description, one skilled in the art can easily ascertain the essential characteristics of this invention and utilize this invention to its fullest extent and, without departing from the spirit and scope thereof, can make various changes and modifications of the invention to adapt it to various usages and conditions.

What is claimed is:

1. A roll of a print medium which comprises a core/spindle and a sheet of a print medium wound around said core/spindle of substantially the same width as said core/spindle to provide a thickness of layered print medium on said core/spindle of at least ½", as measured from the periphery of said core/spindle to the outer layer of said sheet of print medium wound on said core/spindle;

wherein at least one side of said wound sheet of print medium is impressed with at least one identifying mark at a depth sufficient to be detected when viewed at an angle of 45° or less from the surface of an imaginary plane formed by the side of said wound sheet of print medium which is impressed with at least one identifying mark, and any indentation of said identifying mark is sufficiently shallow so as not to inhibit the unwinding of said sheet of print medium off of said core/spindle.

2. A roll as in claim 1 wherein the identifying mark has an indentation at a depth in the range of 0.0" to about 0.010".

3. A roll as in claim 1 wherein more than one identifying mark appears on a side thereof.

4. A roll as in claim 1 wherein at least one identifying mark appears on each side thereof.

5. A roll as in claim 1 wherein the thickness of the layered print medium on said core/spindle is at least 1".

6. A roll as in claim 1 wherein the print medium is selected from the group consisting of plain paper, thermal paper, coated paper, and bond paper.

7. A roll as in claim 1 wherein the identifying mark is free of ink.

8. A roll as in claim 1 wherein the identifying mark is undetectable at a 90° angle from the surface of the imaginary plane formed by the side of said wound sheet of print medium which is impressed with at least one identifying mark.

9. A method which comprises:

providing a roll of a print medium which comprises a core/spindle and a sheet of a print medium wound around said core/spindle of substantially the same width as said core/spindle to provide a thickness of layered print medium on said core/spindle of at least ½", as measured from the periphery of said core/spindle to the outer layer of said sheet of a print medium wound on said core/spindle, pressing a side of said roll of a print medium with a press having a platen with at least one predetermined image raised at least 0.010" from the surface of said platen.

10. A method as in claim 9 wherein the core/spindle and wound print medium are simultaneously aligned with the impression of the identifying mark on the side of said roll of a print medium.

11. A method as in claim 9 which is performed in-line within a roll press used to prepare rolls of a print media.

12. A method as in claim 9 wherein the roll of a print medium is pressed randomly.

13. A method as in claim 9 wherein the roll of a print medium is pressed in a pattern.

14. A method as in claim 9 wherein images are formed on each side of the roll of print medium.

* * * * *